US007525510B2

(12) United States Patent
Beland et al.

(10) Patent No.: US 7,525,510 B2
(45) Date of Patent: Apr. 28, 2009

(54) DISPLAY AND METHOD OF OPERATION

(75) Inventors: Graham N. Beland, Las Vegas, NV (US); William J. Buttram, Las Vegas, NV (US); Michael H. Cox, Las Vegas, NV (US); James B. Gover, Las Vegas, NV (US); James J. Gietzen, Las Vegas, NV (US); John C. Lester, Las Vegas, NV (US); Donald D. Rolfe, Las Vegas, NV (US); Rodney D. Wardle, Las Vegas, NV (US); John S. Williams, Las Vegas, NV (US); Brian W. Young, Las Vegas, NV (US); Scott Fisher, Las Vegas, NV (US)

(73) Assignee: Wynn Resorts Holdings, LLC, Las Vegas, NV (US)

( * ) Notice: Subject to any disclaimer, the term of this patent is extended or adjusted under 35 U.S.C. 154(b) by 882 days.

(21) Appl. No.: 10/922,561

(22) Filed: Aug. 20, 2004

(65) Prior Publication Data

US 2006/0066562 A1 Mar. 30, 2006

(51) Int. Cl.
*G09G 5/00* (2006.01)

(52) U.S. Cl. ..... 345/1.1; 345/108; 345/110; 40/453; 40/464

(58) Field of Classification Search ..... 345/108, 345/109, 110, 1.1, 8; 40/606.14, 606.19, 40/624, 453

See application file for complete search history.

(56) References Cited

U.S. PATENT DOCUMENTS 4,429,478 A * 2/1984 Bruce-Sanders ..... 40/447
4,468,660 A * 8/1984 Ishida et al. ..... 345/109
5,264,930 A * 11/1993 Florence et al. ..... 348/164

(Continued)

FOREIGN PATENT DOCUMENTS

EP 0997865 A2 5/2000

(Continued)

OTHER PUBLICATIONS

Feb. 13, 2003, RealNetworks Inc., pp. 1, 11, 12, <http://service.real.com/help/library/guides/realone/ProductionGuide/HTML/htmfiles/transit.htm>.*

(Continued)

*Primary Examiner*—Amr Awad
*Assistant Examiner*—Jeff Pelligrino
(74) *Attorney, Agent, or Firm*—Greenberg Traurig

(57) ABSTRACT

A sign structure having a display, movable member and computer means creates a unique vehicle for displaying content. In one version, the movable member is adjacent to the display and substantially shields a portion of the display as it traverses thereover. Coordinated content transmitted to the display gives the appearance that the movable member is influencing the displayed content. For example, as the member moves upward an image below the member stretches in size while an image above the member compresses in size until the upper image disappears and the lower image occupies the entire visible portion of the display. This continues as the member traverses up and down over the display. The member may appear to manipulate the images by stretching, compressing, pushing, pulling and/or erasing them.

40 Claims, 11 Drawing Sheets

U.S. PATENT DOCUMENTS

| | | | | |
|---|---|---|---|---|
| 6,178,674 | B1 | 1/2001 | Decaux et al. | |
| 7,025,106 | B2 * | 4/2006 | Donnelly | 160/90 |
| 2004/0085271 | A1 * | 5/2004 | Koll et al. | 345/82 |
| 2005/0024320 | A1 * | 2/2005 | Nowatzyk | 345/108 |

FOREIGN PATENT DOCUMENTS

| | | |
|---|---|---|
| JP | 02020786 | 1/1990 |
| JP | 2003/3263123 | 9/2003 |
| JP | 2004/20734 | 1/2004 |

OTHER PUBLICATIONS

Nov. 28, 1999, Fayette County School District, p. 1, <http://www.fayette.k12.il.us/99/paint/paint.htm>.*

* cited by examiner

DISPLAY AND METHOD OF OPERATION

FIELD OF THE INVENTION

The embodiments of the present invention relate to electronic displays and their operation. More particularly, the embodiments relate to displaying content in a unique manner.

BACKGROUND

With advancements in technology, electronic displays, including LED displays, LCD displays, plasma displays and digital displays, are now commonplace. Any walk through Times Square or along the Las Vegas Strip evidences the fascination with current displays. In such locations the displays are many stories tall such that they are impossible to overlook. The ability to display images and video on such large displays provides the associated businesses with a great deal of versatility in promoting their amenities. For example, a casino may show video clips of a concert by a specific band scheduled to perform live in the casino or show video clips of gaming action on its casino floor.

Similarly, smaller electronic displays are more and more prominent throughout our culture. Airports, hotels and other public locations provide smaller displays for businesses to promote goods and/or services and to attract new customers.

One important advance in display technology, even with larger displays, is the ability to display extremely sharp images or video. Thus, more and more businesses are utilizing the high quality displays to promote their goods and/or services. In particular, most casinos operate one or more large displays on a street front to entertain, educate and attract passersby regarding the casino's amenities, attractions and promotions. The Strip in Las Vegas is well-known for its vast number of resort casinos and their corresponding enormous displays.

Unfortunately, even with the display of sharp images and video, the displays themselves are static and other than the displayed subject matter do not tend to attract viewers. It would be beneficial to develop a more dynamic display unit for presenting images and video content in a more dramatic fashion thereby garnering the attention of a larger number of passersby and attracting more visitors to the corresponding casino or other underlying business.

SUMMARY

Accordingly, a first embodiment of the present invention comprises a display in combination with a dynamic cabinet or carriage. The dynamic cabinet conceals portions of the display as it moves over the display. In a first embodiment, the cabinet moves in upward and downward directions. As a consequence, the cabinet conceals a horizontal segment or strip of the display as it moves thereover.

A computer or similar electronic device controls the cabinet and content presented on the display. As a result, the content on the display is presented so that it appears to be manipulated by the cabinet. For example, while a first image or video clip is being shown on the display, the cabinet may begin to move downward over the display. As the cabinet moves downward, a second image or video clip, or portion thereof, is presented on the display above the level of the cabinet such that the first image is not visible above the cabinet. However, the first image, or a portion thereof, continues to be visible on the display below the level of the cabinet. In this manner, the cabinet appears to be manipulating the displayed images or video clips. In other words, in but one example, the cabinet may appear to erase the first image or video clip and replacing it with the second image or video clip. In fact, the computer is controlling the display of content in cooperation with the movement of the cabinet to present the desired appearance.

Therefore, the use of the cabinet, display and computer creates a more dramatic method to display static and video images or content. Such a method is especially useful in an environment wherein multiple high quality displays are vying for attention. Moreover, there are numerous other content manipulations beyond that disclosed above. Several other such display manipulations are disclosed and described below. In addition, other embodiments and objects of the present invention will become evident as the present invention is described in further detail below.

DETAILED DESCRIPTION

It should be understood that the following detailed description utilizes a specific display design incorporating the inventive and unique features described herein. However, the inventive and unique features are independent of any particular display design. Moreover, the embodiments of the present invention are not limited to large structural display devices but are just as useful with any display device size. As used below, image may refer to a static image, display graphic, video clip or live video feed.

Figure 1:
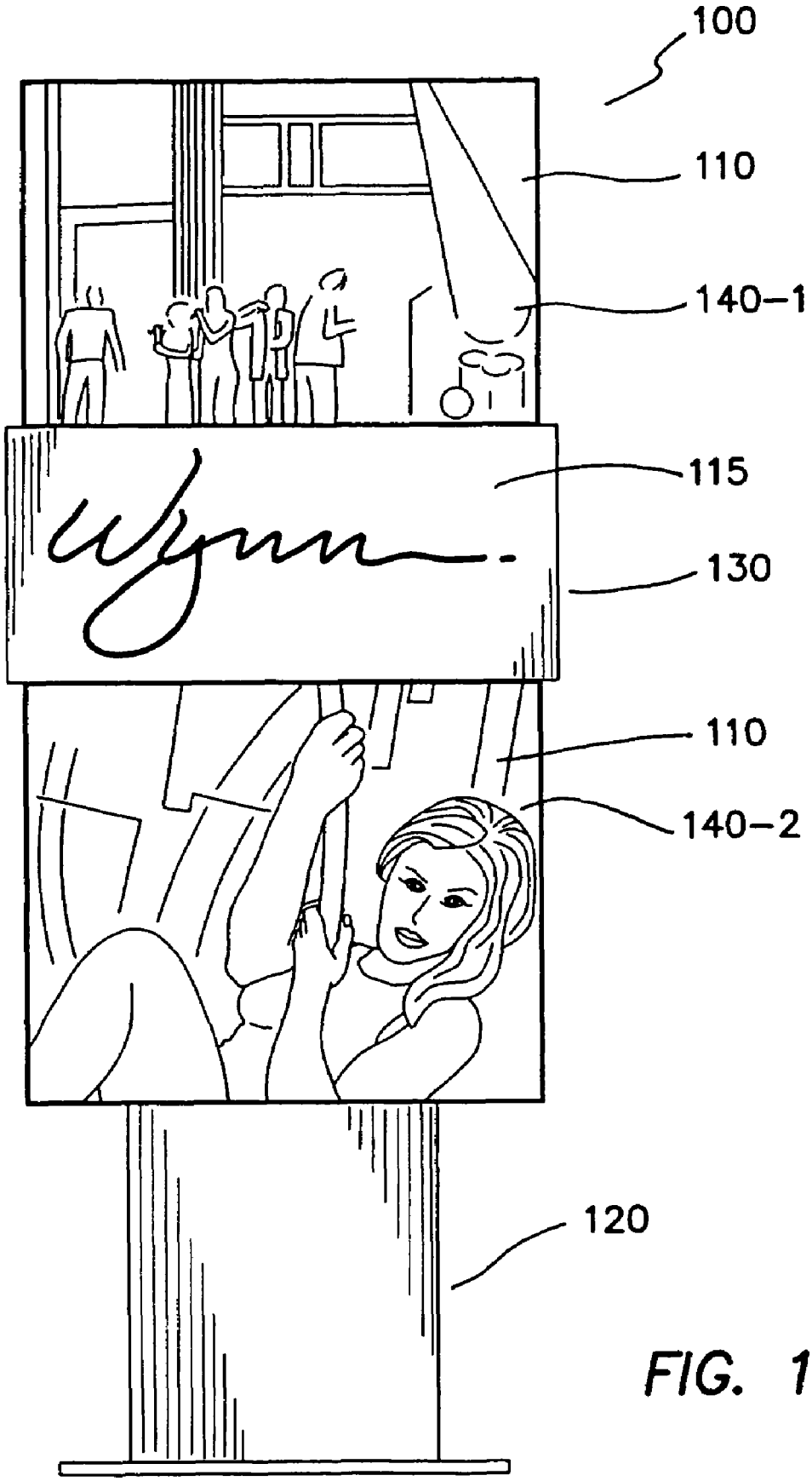
FIG. 1 shows a front view of a display device utilizing a cabinet of a first embodiment of the present invention.
Figure 2:
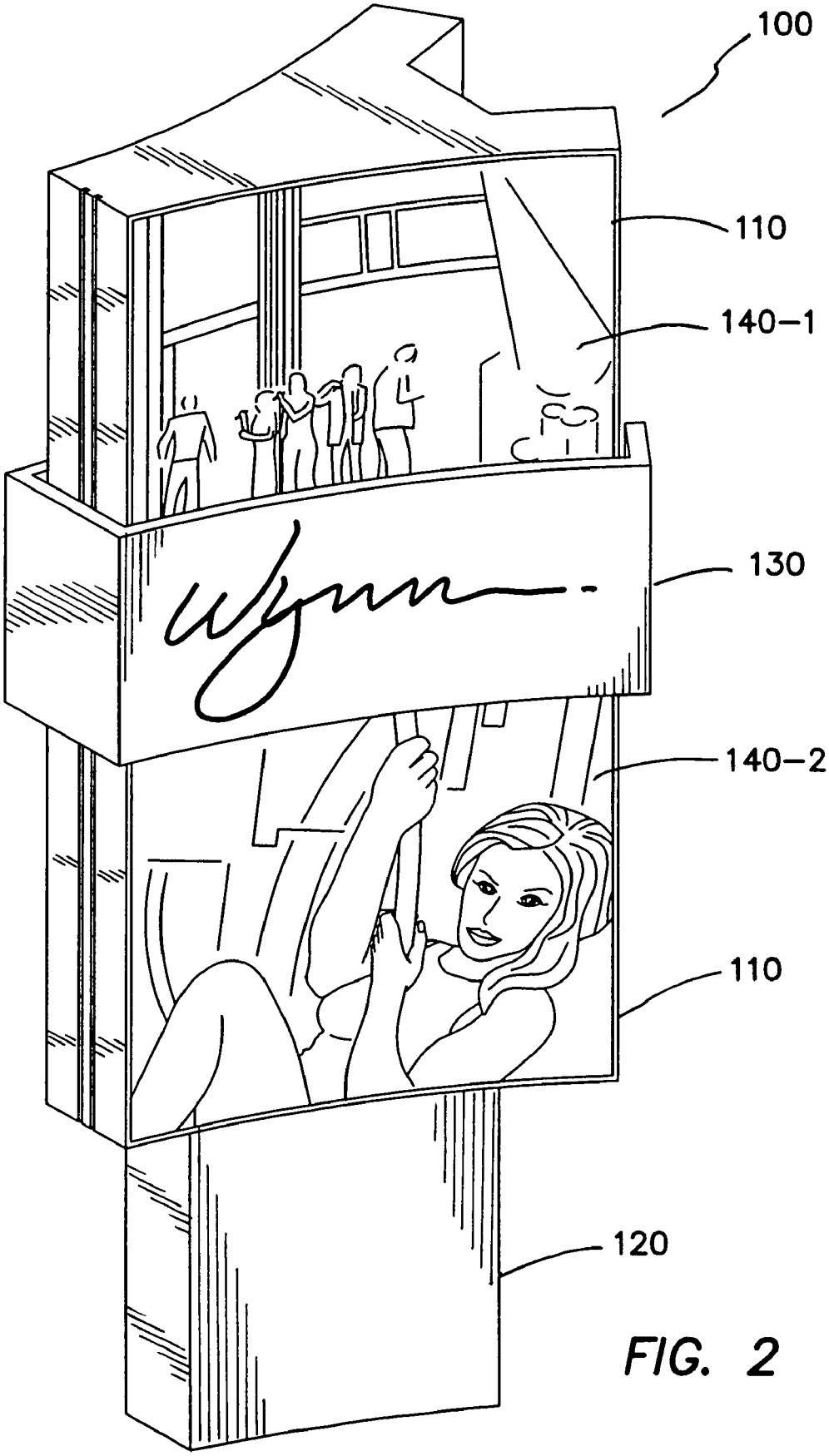
FIG. 2 shows a perspective view of the display device of FIG. 1.

Reference is now made to the figures wherein like parts are referred to by like numerals throughout. FIGS. 1-2 illustrate a display device generally designated by reference numeral 100. The display device 100 includes a display 110, support pylon 120 and cabinet 130. In the example shown, the cabinet 130 is movable in a vertical direction over the display 110. In this manner, as it moves the cabinet 130 is made to appear to manipulate the two images 140-1 and 140-2. For example, referring to FIGS. 1-2 and assuming the cabinet 130 is moving downward, the concert image 140-1 stretches to cover the portion of the display 110 above the cabinet 130 while the woman on the rope image 140-2 compresses until the cabinet 130 reaches its bottom maximum position such that the concert image 140-1 occupies the entire visible portion of the display 100 and the woman on the rope image 140-2 disappears.

The manipulation of the images 140-1 and 140-2 may take many forms. In another version, as the cabinet moves 130 from a maximum top or bottom position, the first image, in this case as the cabinet 130 moves downward, the concert image 140-1, appears to be pulled onto the display 110 as the second image, in this case the woman on the rope image 140-2, appears to be pushed off the display 110. In other words, neither image 140-1 or 140-2 is altered proportionally but the total images 140-1 and 140-2 appear to be moving in a downward direction. In another alternative version, images 140-1 and 140-2 may appear to be stretched and compressed, respectively. In such a version, each image 1401- and 140-2 is displayed in full albeit the images are sometimes in a stretched or compressed state. In another alternative version, the cabinet 130 acts like an eraser appearing to systematically erase one image as the other image takes its place. Other image manipulations, including manipulations created by utilizing a vertically positioned cabinet which moves left to right, are conceivable.

Figure 3:
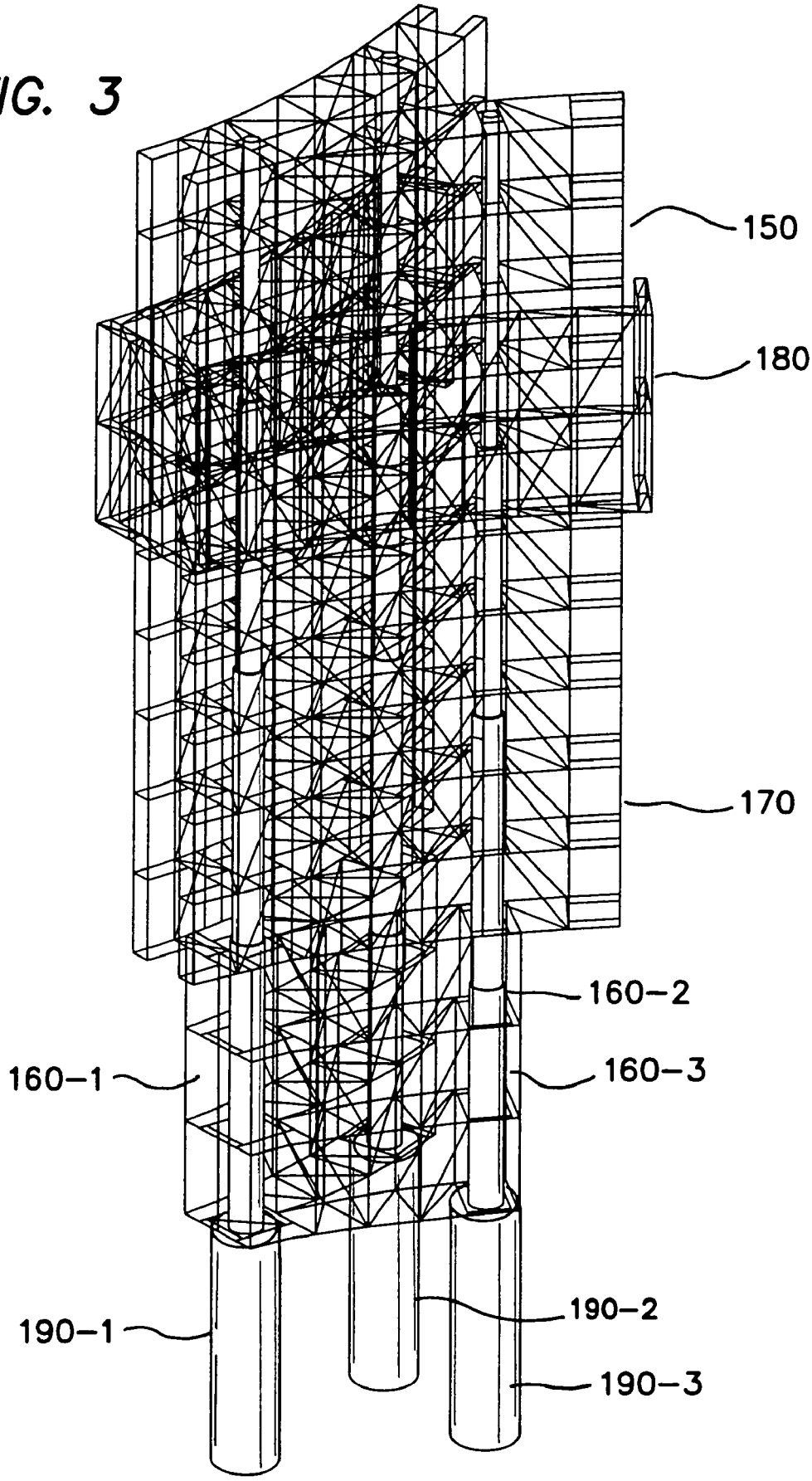
FIG. 3 shows a perspective view of a display device support.

Now referring to FIG. 3, a perspective view of a display device support 150 comprises a series of support pillars 160-1 through 160-3, a support frame 170 and a cabinet frame 180. The support frame 170 and cabinet frame 180 comprise a series of truss components which are ideally fabricated of a metal alloy, such as aluminum or steel. The pillars 160-1 through 160-3 each include footings 190-1 through 190-3. In practice, the footings 190-1 through 190-3 are planted in the ground to support the remaining portion of the display structure 150 which extends above ground level. Ideally the footings 190-1 through 190-3 are formed of concrete or similar material.

As shown in FIG. 3 and others, the V-shaped display device support 150 may accommodate two generally oppositely facing displays 110 utilizing a single cabinet frame 180. In this arrangement, passersby from opposite directions may view similarly manipulated content.

Figure 4:
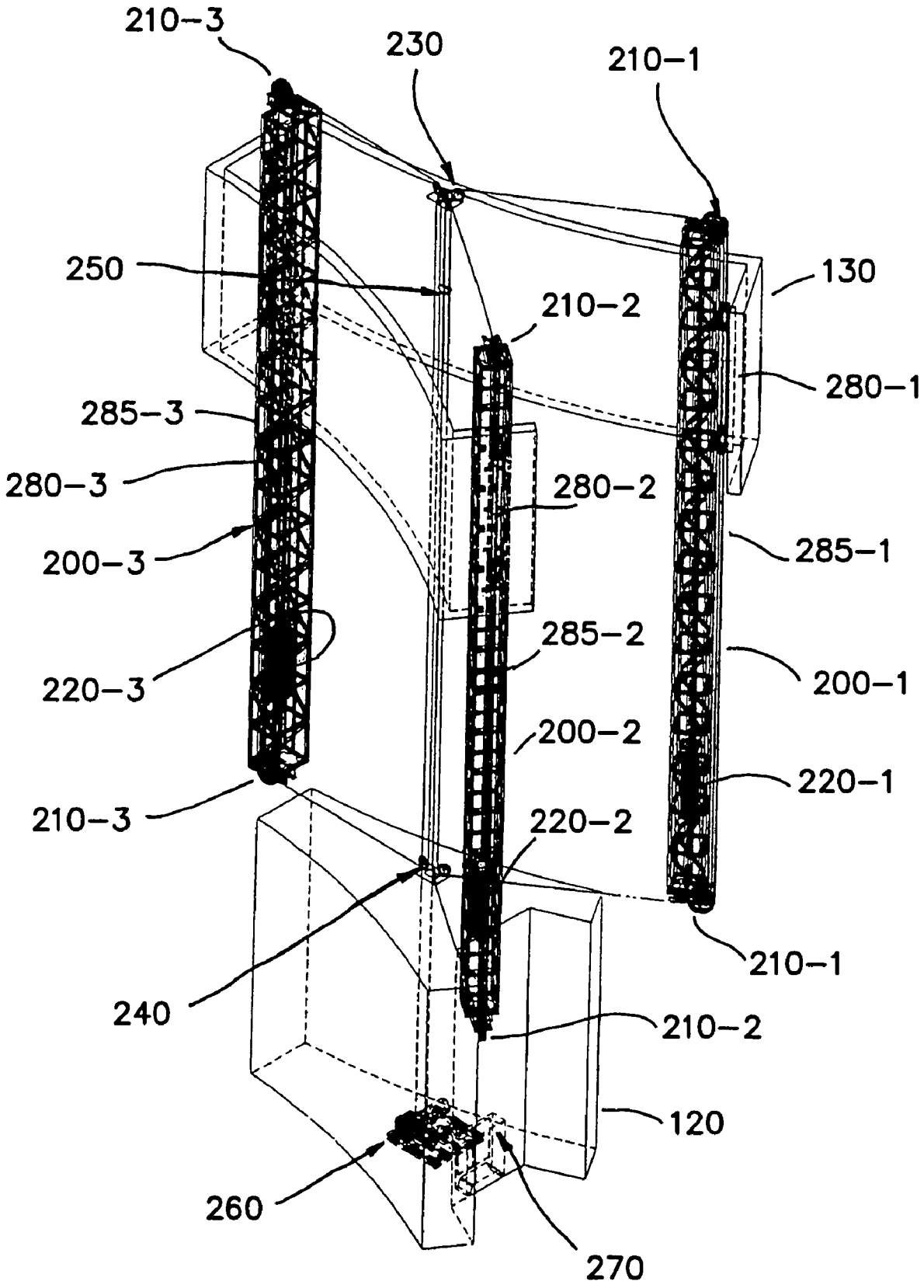
FIG. 4 shows a perspective view of a mechanical cabinet control system.

FIG. 4 shows a partially transparent view of the display device 100. Three vertical trusses 200-1 through 200-3 act as control towers for a mechanical cabinet control system. The trusses 200-1 through 200-3 each support a pulley system 210-1 through 210-3 at each end thereof and a counterweight assembly 220-1 through 220-3. The display device support 150 further supports two pulley systems comprising an upper pulley system 230 and a lower pulley system 240. A network of cables 250 joins the counterweight assemblies 220-1 through 220-3 to a motor and winch assembly 260 (shown in more detail in FIG. 10). The motor and winch assembly 260 drive the movements of the cabinet 130. The cabinet 130 is supported by pickup devices 280-1 through 280-3 which ascend and descend along guide tracks 285-1 through 285-3. A motor control center 270 communicates and instructs the motor and winch 260. As described below, the motor control center 270 receives its instructions from one or more computers.

Figure 5:
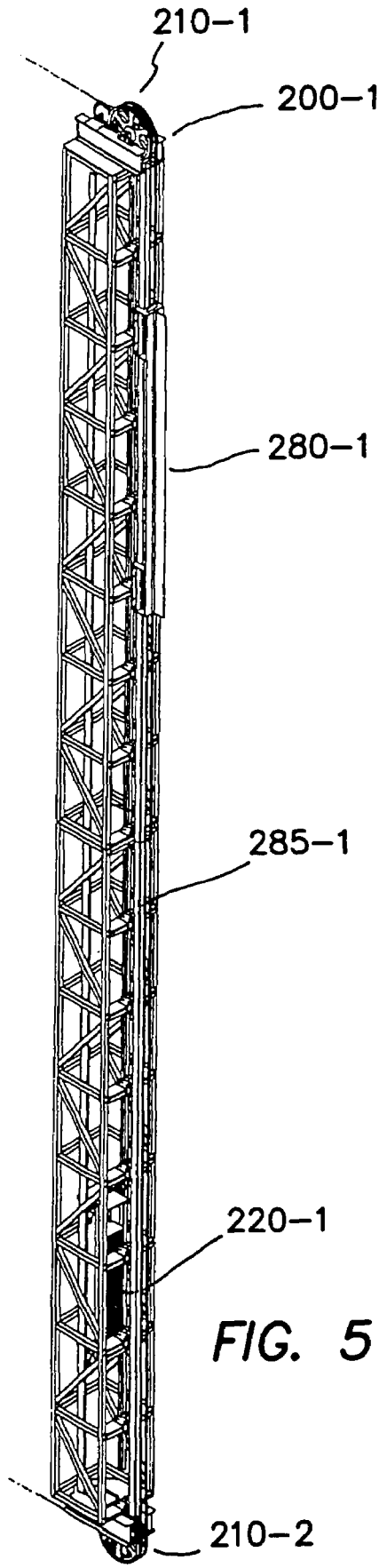
FIG. 5 shows a perspective side view of one control tower of the mechanical cabinet control system of FIG. 4.
Figure 6:
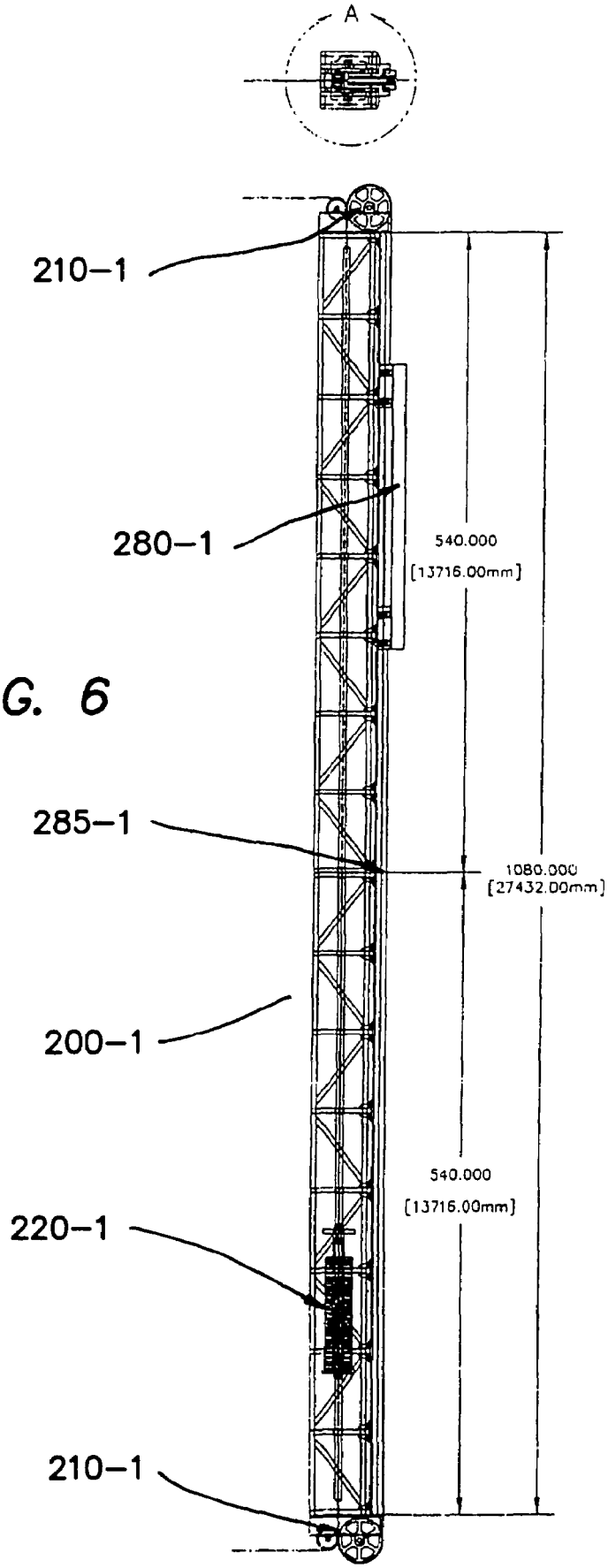
FIG. 6 shows a side view of side view of one control tower of the mechanical cabinet control system of FIG. 4.

FIGS. 5 and 6 show a perspective view and side view, respectively, of the single truss section 200-1. As seen in FIGS. 5 and 6, the pickup device 280-1, along with the other pickup devices, is able to ascend and descend along its guide track 285-1 on an outer portion of the truss section 200-1 thereby moving the attached cabinet 130 (not shown in FIGS. 5 and 6) in a predetermined fashion. As seen in FIG. 4, each pick up device 280-1 through 280-3 has a corresponding guide track 285-1 through 285-3. The operation of the pickup devices 280-1 though 280-3 is facilitated by the counterweight assemblies 220-1 through 220-3 which reside, and are free to ascend and descend, within an interior portion of said truss sections 200-1 through 200-3.

Figure 7:
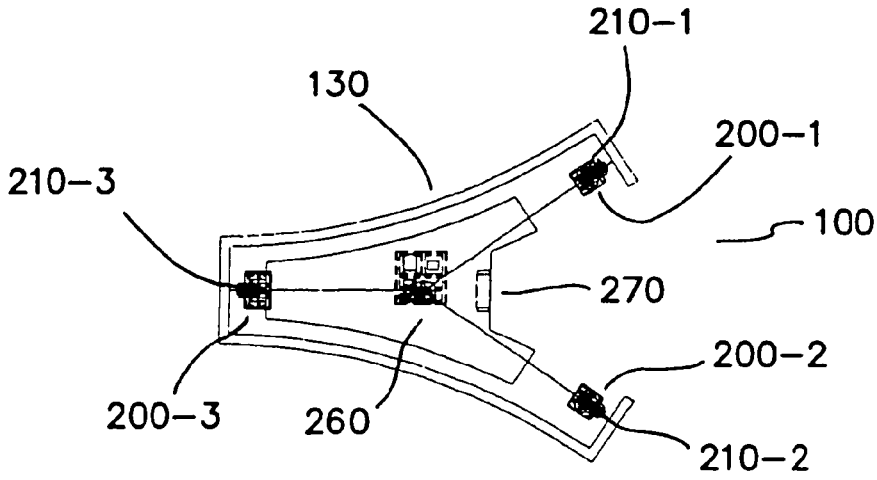
FIG. 7 shows a top view of the control tower of FIG. 5.

FIG. 7 shows a top view of the display device 100 with certain internal features, including the pulley systems 210-1 through 210-3, cables 250, motor and winch assembly 260 and motor control center 270, exposed. The cabinet 130 is also shown in place.

Figure 8:
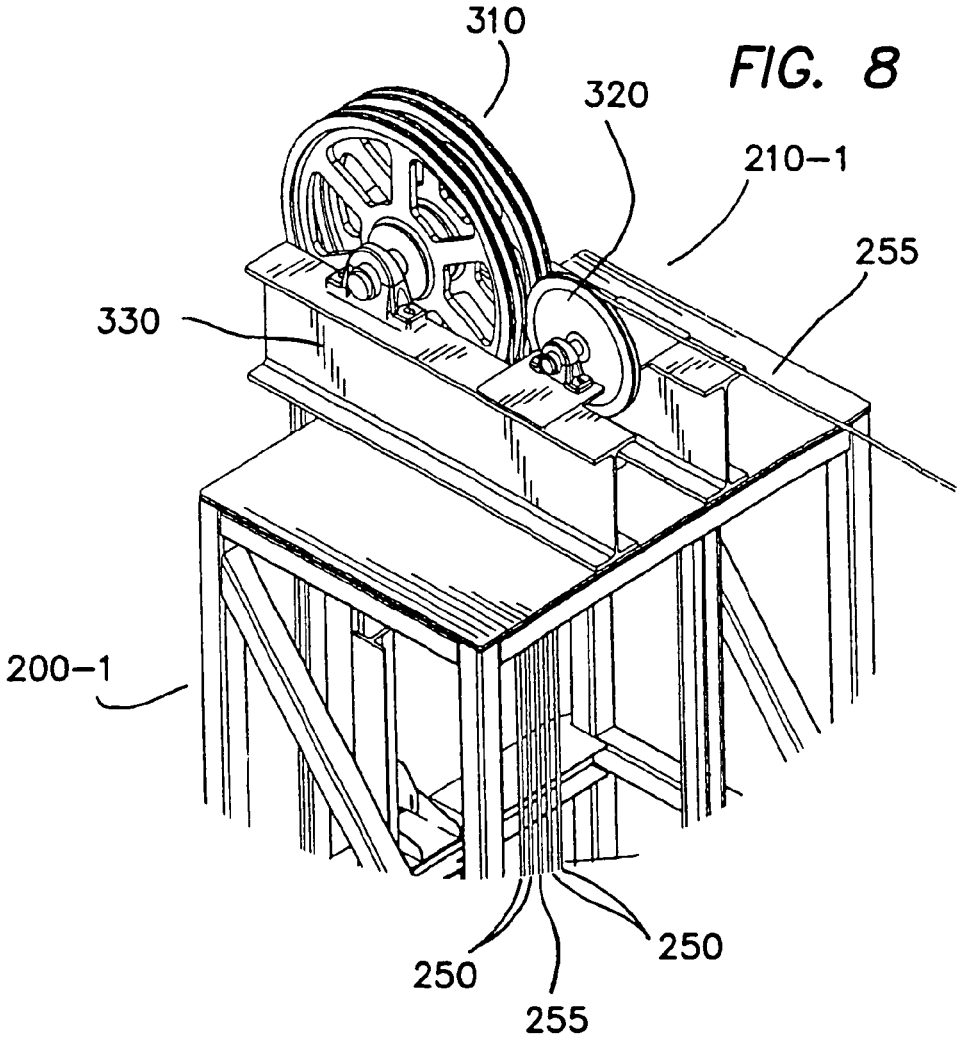
FIG. 8 shows a pulley device of the mechanical cabinet control system.
Figure 9:
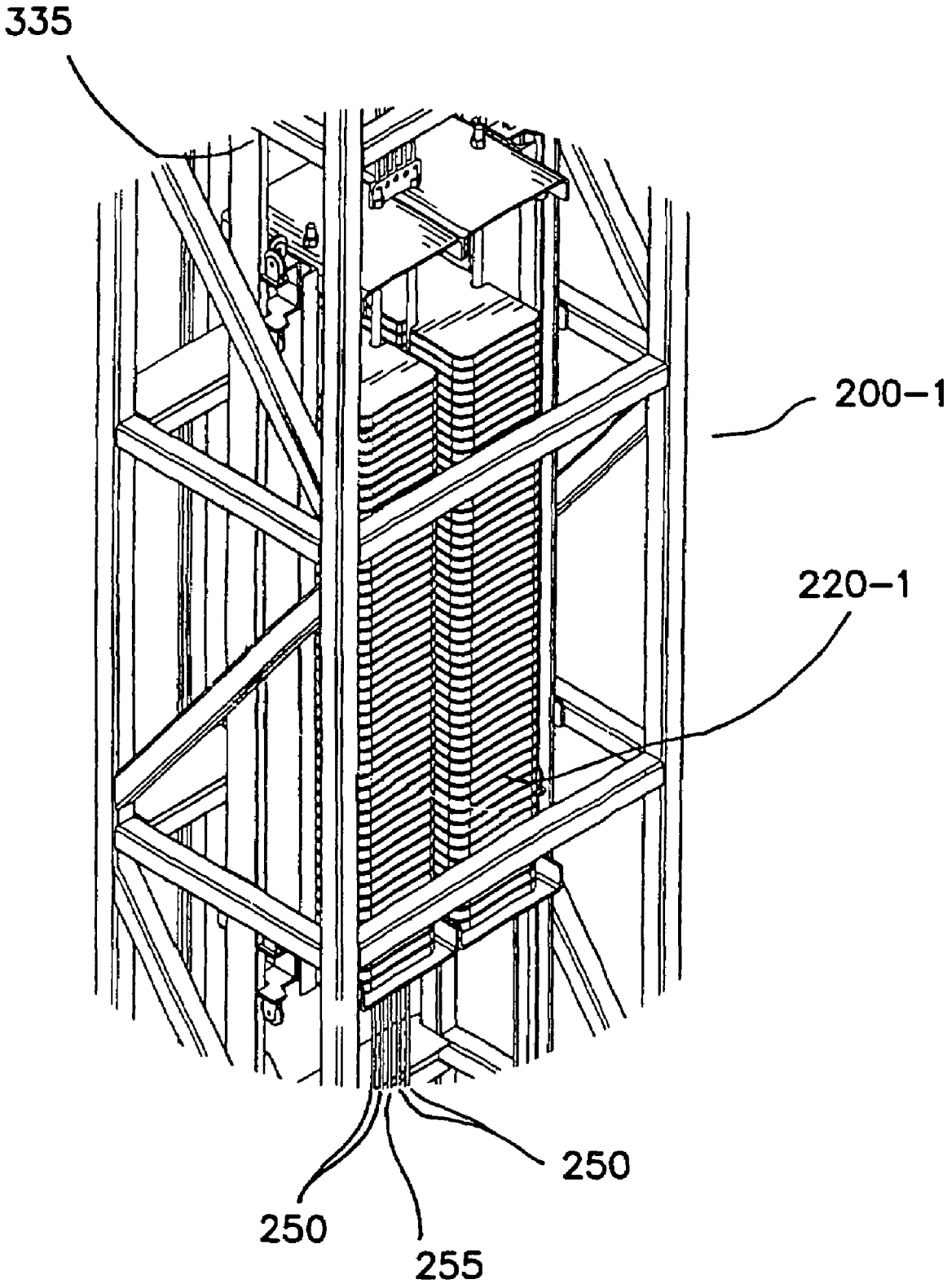
FIG. 9 shows a counter-weight assembly of the mechanical cabinet control system.
Figure 10:
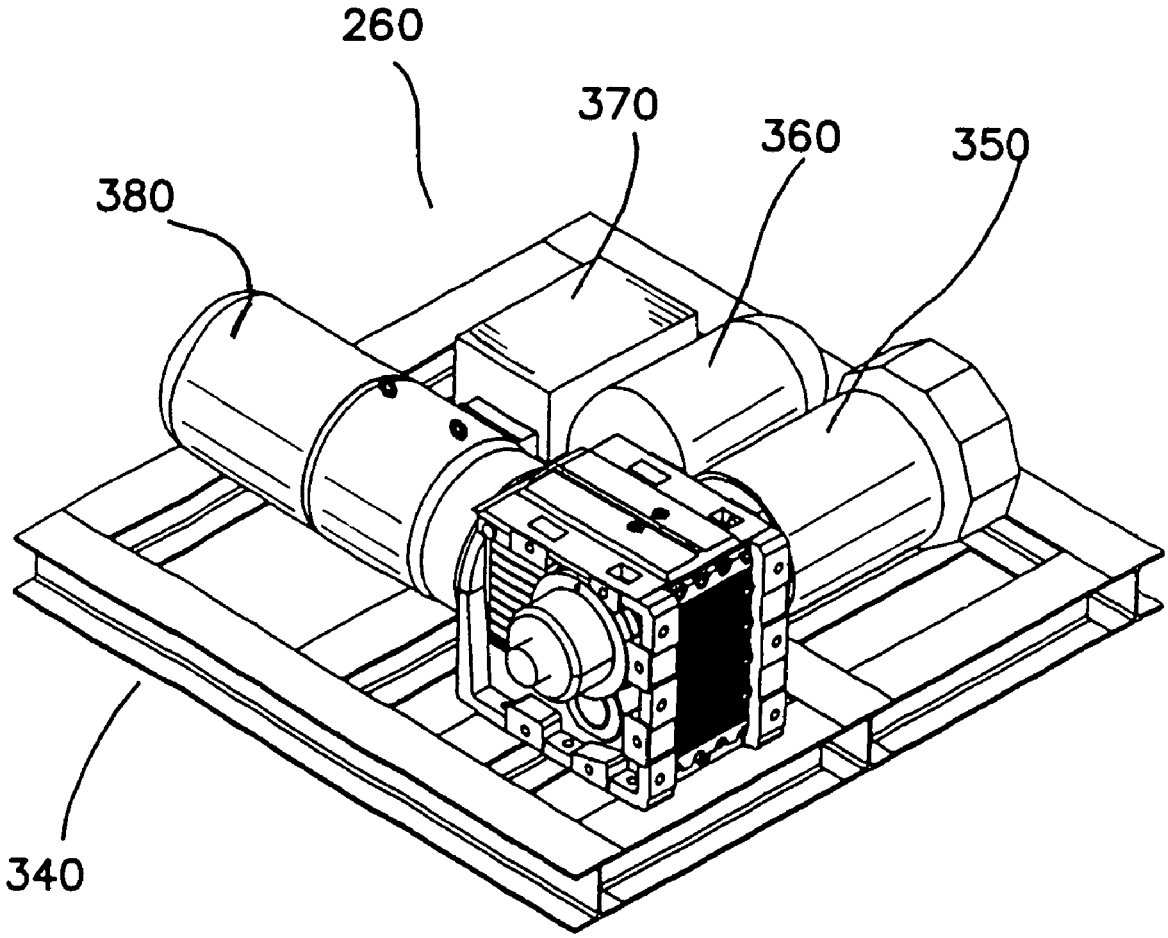
FIG. 10 shows a motor and winch assembly.

FIGS. 8-10 show detailed views of the pulley system 210-1, counterweight assembly 220-1 and the motor and winch assembly 260. As shown in FIG. 8, the pulley system 210-1 includes a first wheel 310 aligned with a and second wheel 320 and a pulley support member 330. The first wheel 310 supports four cables 250 secured at a first end to the counterweight assembly 220-1 and the second wheel 320 supports a single cable 255 attached at a first end to the counterweight assembly 220-1. The single cable 255 then extends to the upper pulley system 230 and lower pulley system 240 and eventually to connection with the motor and winch assembly 260. Each end of the truss section 200-1 incorporates an identical pulley system 210-1. Similarly, identical pulley systems 210-2 and 210-3 are secured to each end of the truss sections 200-2 and 200-3, respectively. The pulley systems 210-2 and 210-3 accommodate identical cable arrangements as well.

FIG. 9 shows the counterweight assembly 220-1 within the confines of the truss section 200-1. The counterweight assembly 220-1 is slidably engaged to parallel tracks 335 which extend the height of the truss section 200-1. Cables 250 and 255 are attached to an upper portion of the counterweight assembly. Cables 250' and 255' extend from underneath the counterweight assembly 220-1.

The motor and winch assembly 260 is shown in FIG. 10. The assembly 260 includes a base 340, cable drum 350, air accumulator 360 and junction box 370. In practice, the cable drum 350 is engaged by at least one cable from the mechanical cabinet control system. As needed, the cable drum 350 is driven by the motor 380 of the motor and winch assembly 260 thereby raising or lowering the cabinet 130 as needed. In most instances, the movement of the cabinet 130 is systematic and routine in an upward direction to a maximum limit and then downward to a maximum limit (or vice versa) and so on. However, the content being displayed ultimately dictates the nature of the cabinet 130 movement.

Figure 11:
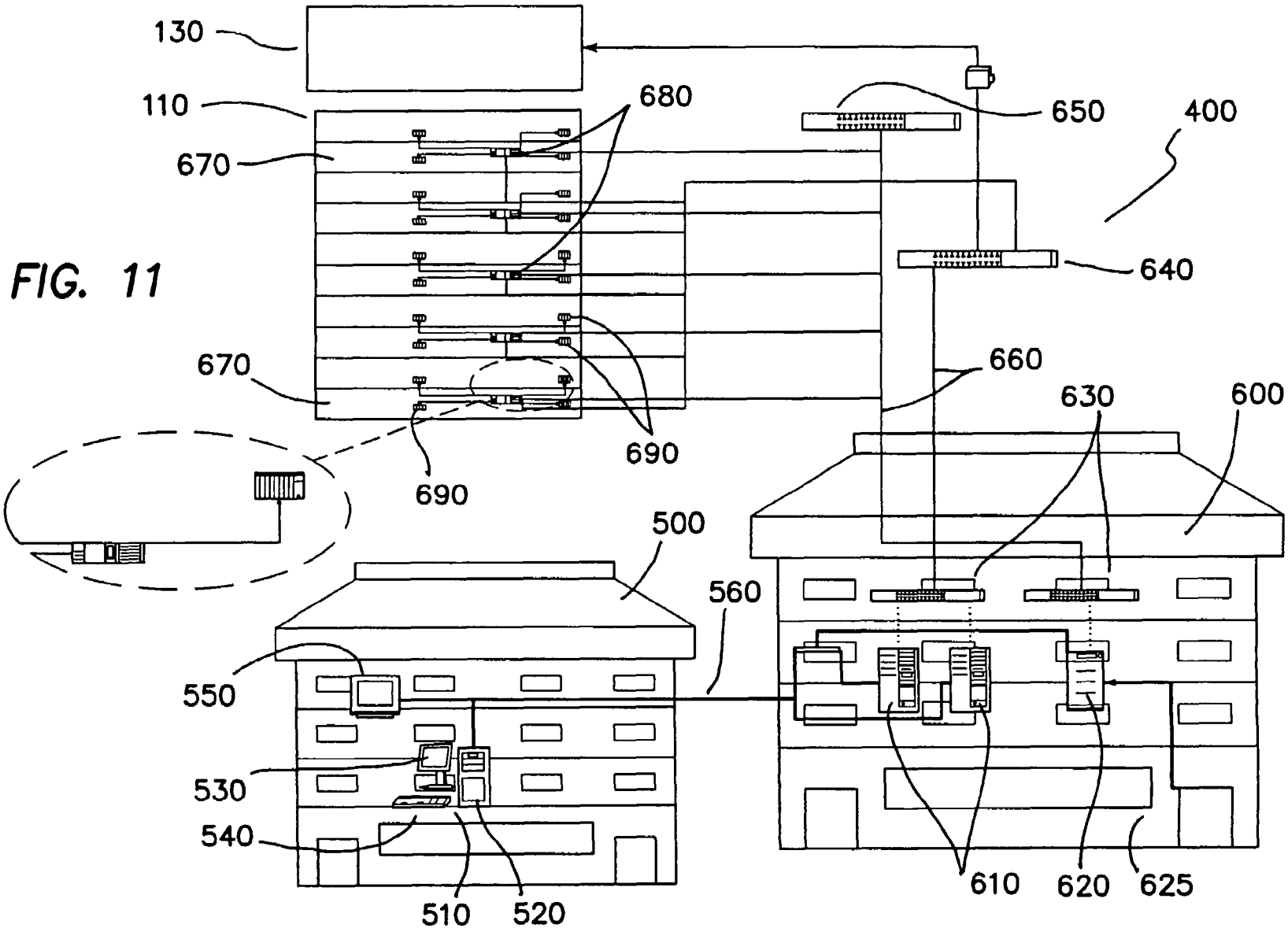
FIG. 11 shows a diagram of a computer network for operating the display and mechanical cabinet control system.

The operation of the display device 100, including the display 110, cabinet 130 and related features, is controlled by one or more computer processors. FIG. 11 shows a block diagram of one embodiment of a computer network 400 for operating the display device 100. The network 400 comprises a content creation portion 500 and storage and IT portion 600.

The content creation portion 500 facilitates the creation of content or material for viewing on the one or more displays 110. In one embodiment, the content creation portion 500 comprises at least a personal computer system 510 having a central processing unit (CPU) 520, display 530 and keyboard 540. Suitable software for one exemplary computer system 510 includes a WindowsXP Pro® operating system, Adobe AfterEffects® and Adobe Premier®. The Adobe® software provides a means for personnel to create, manipulate and view content for later display on the display device 100. Suitable hardware components include a Pentium 4® 3.0 GB CPU, 2.0 GB of Ram and 200 GBx2 Raid Drives. Those skilled in the art will recognize that other software and/or hardware is just as suitable for the desired task of creating, manipulating and viewing display content.

Optionally, a plasma screen 550 or the equivalent may be connected to the computer system 510 to provide an enhanced device for previewing content creations. Ideally, the computer display 530 and/or plasma screen 550 recreate the concealment of the cabinet 130 thereby providing a realistic impression of the final product to be displayed on the display device 100.

Once content is created, it is transmitted to the storage portion 600 of the computer network 400. The transmission may occur via a wired Ethernet connection 560, such as fiber or Cat 5 wiring, or may be accomplished via a wireless connection. The storage portion 600 consists of one or more file servers 610, a live video server 620 and one or more switches 630. Suitable file server 610 models include a Dell® PowerEdge 4600 running on a Windows® platform. A suitable storage unit utilizes 146 GB of Raid 5 Drives. Those skilled in the art will recognize that other software and/or hardware is just as suitable for the desired task of storing and transmitting data, such as instructions and content, via stored media Ethernet Switch/Hub 640, to the display 110. The live video server 620 receives content from a live video source 625 and streams it via a real-time live video Ethernet Switch/Hub 650 to the display 110. Ideally, the streaming and transmission of data to the display 110 is facilitated by fiber connections 660.

Control of the cabinet 130 is effectuated by its connection with the one or more file servers 610. That is, the content being displayed and the movement of the cabinet 130 work in tandem to create the desired effect on the display 110. Accordingly, the file servers 610, namely the stored data, ensure the speed and direction of the cabinet 130 work in unison with the content to produce the desired effect.

In one embodiment, the display 110 is a light emitting diode (LED) display comprising 1200 pixels in a 100 foot vertical orientation and 608 pixels in a 50 foot-8 inch horizontal orientation. The number of pixels may be modified to alter the overall resolution of the display 110. The display 110 is segmented into a plurality of horizontal portions 670 with each portion 670 having a player module 680 and one or more LED control interfaces 690. The player modules 680 stream content data, including video, from the file servers 610 or the live video server 620 and use the content to drive the LEDs via the LED control interfaces 690. Obviously, other display types, including LCD, plasma and digital, may be used in conjunction with the embodiments of the present invention.

In this manner, the cabinet 130 is used in combination with the content data to create a unique display of information. For example, as disclosed above, manipulations may facilitate the appearance of a push-pull, stretch-compress or eraser scenario involving multiple images displayed, at least in part, simultaneously.

The computer processors and related systems of the embodiments of the present invention are capable of generating error notices regarding display device 100 operation to personnel maintaining the display device 100. Accordingly, any system or component malfunction can be quickly evaluated and repaired to keep the display device 100 downtime to a minimum.

As seen in FIGS. 1 & 2, it is also conceivable for the cabinet 130 to include promotional material 115 in the form of permanent logos, trademarks and related information or the cabinet 130. The promotional material 115 on the cabinet may be presented by means of a plurality of lights. Indeed, the lights may be programmed to illuminate such that the signature is completed in a handwriting fashion. Alternatively, the logo 115 may be formed of any visible non-illumination material.

Figure 12:
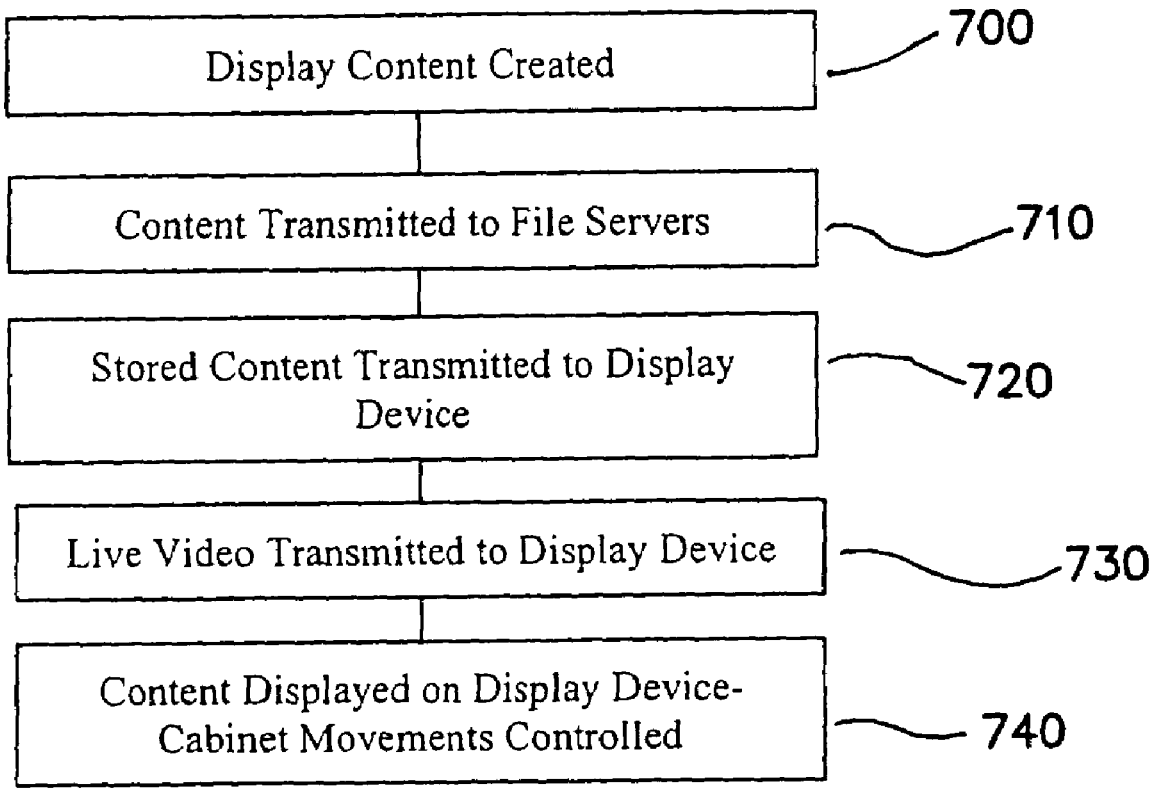
FIG. 12 shows a flow chart of one practical application of the embodiments of the present invention.

Now referring to FIG. 12, a flow chart 700 details one general embodiment of the present system. At step 710, display content is created and viewed using a computer system including software and hardware components. Once the content is approved, at step 720, the content is transmitted to one or more file servers for storage. At step 730, the stored content is transmitted to a display device incorporating a movable cabinet. Optionally, at step 740, live video may also be transmitted to the display in combination with said stored content or on its own. At step 750, the content is displayed on the subject display in conjunction with cabinet movements thereby creating the desired visual presentation.

Although the invention has been described in detail with reference to several embodiments, additional variations and modifications exist within the scope and spirit of the invention.

We claim:

1. A sign structure comprising:

a display;

a movable member adjacent said display, said movable member substantially shielding a portion of the display;

means for transmitting content to said display, said content comprising a first static or video image and a second static or video image;

software means for manipulating said first image by compressing or moving said first image so that all or portions of said first image occupy a decreasing display area in front of said movable member as it moves over said display and said second image by expanding or moving said second image so that all or portions of said second image occupy an increasing display area rear of said movable member as it moves over said display; and means for controlling said movable member such that the movable member moves in harmony with content being displayed, wherein said movable member separates two unique static or video images as said movable member moves over said display.

2. The sign structure of claim 1 wherein the means for transmitting content to said display comprises one or more computer processors in communication with said display.

3. The sign structure of claim 1 wherein the means for controlling said movable member comprises a system of pulleys and counterweights in communication with one or more computer processors.

4. The sign structure of claim 1 wherein the content comprises two distinct images.

5. The sign structure of claim 4 wherein the movable member forms a border separating the two images.

6. The sign structure of claim 5 wherein the movable member is oriented in a horizontal position and moves up and down.

7. The sign structure of claim 6 wherein a first image remains above the movable member and a second image remains below the movable member.

8. The sign structure of claim 1 wherein the display comprises a plurality of light emitting diodes.

9. A display device comprising:

one or more display screens;

a cabinet translatable in relation to the one or more display screens, said cabinet concealing a portion of the one or more display screens; and control means for controlling movements of the cabinet and electronically manipulating content, in the form of a first static or video image and a second static or video image, transmitted to the one or more display screens, wherein said cabinet separates said first and second static or video images as said cabinet moves over said display, said manipulation comprising compressing or moving said first image so that all or portions of said first image occupy a decreasing display area in front of said cabinet as it moves over said display and said second image by expanding or moving said second image so that all or portions of said second image occupy an increasing display area rear of said cabinet as it moves over said display.

10. The display device of claim 9 wherein the movements of the cabinet appear to influence the content presented on the one or more display screens.

11. The display device of claim 9 wherein the control means comprises one or more central processing units in communication with the cabinet and the one or more display screens.

12. The display device of claim 9 wherein the content comprises two distinct images.

13. The display device of claim 12 wherein the cabinet separates the two images.

14. The display device of claim 9 wherein the cabinet is oriented in a horizontal position and moves up and down.

15. The display device of claim 14 wherein a first image remains above the cabinet and a second image remains below the cabinet.

16. The display device of claim 9 wherein the display is formed of a plurality of light emitting diodes.

17. A sign structure comprising:

a display;

a movable member adjacent said display, said movable member substantially concealing a portion of the display;

a system of pulleys and counterweights connected to said movable member;

one or more computer processors for transmitting content, in the form of a first static or video image and a second static or video image, to said display and controlling said system of pulleys and counterweights thereby controlling the movements of the movable member such that the movable member moves in concert with the displayed content, wherein said movable member separates said first and second static or video images as said movable member moves over said display; and software means for manipulating said first image by compressing or moving said first image so that all or portions of said first image occupy decreasing display area in front of said movable member as it moves over said display and said second image by expanding or moving said second image so that all or portions of said second image occupy an increasing display area rear of said movable member as it moves over said display.

18. A method of displaying content comprising:

transmitting a first static or video image and a second static or view image to one or more display screens;

controlling movements of a display screen blocker; and manipulating said first image by compressing or moving said first image so that all or portions of said first image occupy a decreasing display area in front of said display screen blocker as it moves over said display and said second image by expanding or moving said second image so that all or portions of said second image occupy an increasing display area rear of said display screen blocker as it moves over said display.

19. The method of claim 18 wherein transmitting at least two distinct images and controlling movements of the display screen blocker are accomplished by one or more computer processing units.

20. The method of claim 18 wherein the static images are stored in a device in communication with said one or more display screens.

21. The method of claim 18 wherein the display blocker substantially conceals a horizontal portion of the one or more display screens.

22. The method of claim 21 wherein as the display blocker moves up and down one image remains above the blocker and a second image remains below the display blocker.

23. The method of claim 18 wherein the images are manipulated such that display blocker appears to erase an image as it moves in a direction of the image.

24. The method of claim 18 wherein the images are manipulated such that the display blocker appears to compress an image as it moves in a direction of the image.

25. The method of claim 18 wherein the images are manipulated such that the display blocker appears to force an image off the display screen as it moves in a direction of the image.

26. The method of claim 18 wherein the images are manipulated such that display blocker appears to stretch an image as it moves in a direction away from the image.

27. The method of claim 18 wherein the images are manipulated such that display blocker appears to pull a first image onto the display screen as it moves in a direction away from the image.

28. A method of displaying content comprising:

transmitting the content to one or more display screens, said content including a first static or video image and a second static or video image;

controlling movements of a display screen blocker separating said first and second images; and manipulating said first image by compressing or moving said first image so that all or portions of said first image occupy a decreasing display area in front of said display screen blocker as it moves over said display and said second image by expanding or moving said second image so that all or portions of said second image occupy an increasing display area rear of said display screen blocker as it moves over said display.

29. A system for displaying content comprising:

means for creating content;

means for transmitting said content to a display device, said display device including a cabinet movable over a display screen of said display device;

means for controlling movements of the cabinet in conjunction with the displayed content to create a desired effect, wherein said cabinet separates a first static or video image and a second static or video image as said cabinet moves over said display screen; and software means for manipulating said first image by compressing or moving said first image so that all or portions of said first image occupy a decreasing display area in front of said movable member as it moves over said display and said second image by expanding or moving said second image so that all or portions of said second image occupy an increasing display area rear of said movable member as it moves over said display.

30. The system of claim 29 wherein the means for creating content comprises a computer having software and hardware components.

31. The system of claim 29 wherein the means for transmitting said content to the display screen comprises a wired connection.

32. The system of claim 29 wherein the means for transmitting said content to the display screen comprises a wireless connection.

33. The system of claim 29 wherein the means for controlling movements of the cabinet comprises a computer processor.

34. The system of claim 33 wherein the computer processor controls operation of a pulley and counterweight combination to control the movements of the cabinet.

35. The system of claim 29 wherein the desired effect comprises the cabinet moving up and down while one image remains above the cabinet and a second image remains below the cabinet.

36. The system of claim 29 wherein the desired effect comprises the cabinet appearing to erase an image as it moves in a direction of the image.

37. The system of claim 29 wherein the desired effect comprises the cabinet appearing to compress an image as it moves in a direction of the image.

38. The system of claim 29 wherein the desired effect comprises the cabinet appearing to force an image off the display screen as it moves in a direction of the image.

39. The system of claim 29 wherein the desired effect comprises the cabinet appearing to stretch an image as it moves in a direction away from the image.

40. The system of claim 29 wherein the desired effect comprises the cabinet appearing to pull a first image onto the display screen as it moves in a direction away from the image.

* * * * *

UNITED STATES PATENT AND TRADEMARK OFFICE

CERTIFICATE OF CORRECTION

PATENT NO. : 7,525,510 B2
APPLICATION NO. : 10/922561
DATED : April 28, 2009
INVENTOR(S) : Graham N. Beland et al.

It is certified that error appears in the above-identified patent and that said Letters Patent is hereby corrected as shown below:

Column 7, line 45, after "occupy" insert -- a --.

Signed and Sealed this

Second Day of June, 2009

JOHN DOLL
*Acting Director of the United States Patent and Trademark Office*